United States Patent [19]

Tateno

[11] Patent Number: 4,989,218

[45] Date of Patent: Jan. 29, 1991

[54] INDUCTION HEATING TYPE METAL MELTING21FURNACE

[75] Inventor: Masao Tateno, Kanagawa, Japan

[73] Assignee: Fuji Electric Co., Ltd., Kanagawa, Japan

[21] Appl. No.: 492,484

[22] Filed: Mar. 12, 1990

[30] Foreign Application Priority Data

Mar. 13, 1989 [JP] Japan ..... 1-60108

[51] Int. Cl.[5] ..... H05B 6/06

[52] U.S. Cl. ..... 373/145

[58] Field of Search ..... 373/145, 75, 76, 118, 373/137, 155, 156, 157, 158

[56] References Cited

U.S. PATENT DOCUMENTS 1,922,029 8/1933 Chesnut ..... 373/145
2,990,542 6/1961 Seitz ..... 373/155
4,000,595 1/1977 Fortescue ..... 373/137
4,205,197 5/1980 Omori et al. ..... 373/145

FOREIGN PATENT DOCUMENTS 1208451 1/1966 Fed. Rep. of Germany ..... 373/155

*Primary Examiner*—Bruce A. Reynolds
*Assistant Examiner*—Tu Hoang
*Attorney, Agent, or Firm*—Finnegan, Henderson, Farabow, Garrett and Dunner

[57] ABSTRACT

An induction furnace is disclosed, including a porous furnace wall formed by sintering castable refractory material. Gas passageways are formed in the furnace wall, and a common pipe connecting the gas passageways is connected to a gas conveying unit provided outside of the furnace wall. An outer gas-blocking layer surrounds the furnace wall.

8 Claims, 1 Drawing Sheet

INDUCTION HEATING TYPE METAL MELTING21FURNACE

BACKGROUND OF THE INVENTION

1. Field of the Invention

The present invention relates to an induction furnace used for melting metal, such as a crucible type induction furnace or groove type induction furnace in which metal is molten by induction heating, and the resultant molten metal is kept at a desired temperature.

2. Description of the Related Art

A conventional induction furnace, used for example to melt metal, includes a furnace body of refractory material, encircled by an induction coil. If this conventional furnace body is cracked, then the molten metal may leak out to touch the induction coil, thus causing a great accident. In order to detect the occurrence of such an accident, the induction furnace is typically provided with a molten metal leakage detecting unit.

Such molten metal leakage detecting units have been disclosed by Japanese Utility Patent Application (OPI) No's 101792/1988 and 159892/1984, Japanese Patent Application (OPI) No. 182568/1987, and Japanese Utility Patent Application Publication 7278/1983 (the term "OPI" as used herein means an "unexamined published application").

A typical example of the conventional molten metal leakage detecting units will be described with reference to FIG. 4. When its furnace body 1 of a crucible type induction furnace of refractory material is abnormally damaged, or cracked, the molten metal 3 will leak out of the furnace body. The leakage of the molten metal is detected as follows. A first electrode 4 is provided in the bottom of the furnace body 1 in such a manner that it is in contact with the molten metal 3 of the furnace body 1. A second electrode 5 of aluminum or stainless steel foil is located between an induction coil 2 wound on the furnace body 1 and the outer surface of an heat insulating layer covering the outer cylindrical wall of the furnace body 1. Outside the furnace body 1, a predetermined voltage is applied across the first and second electrodes 4 and 5. When the molten metal 3 leaks out of the furnace body 1 through the cracks or the like, and contacts second electrode 5, a current path is created between first and second electrodes 4 and 5 via the molten metal 3. Thus current will flow between the two electrodes, and be detected with an ampere meter 6. In other words, deflection of ampere meter 6 indicates presence of a leak. In response to the detection, an audible alarm signal is produced.

While this invention relates in part to the above-described molten metal leakage detecting technique, it relates more specifically to a furnace building technique which will make the above leak-detection technique unnecessary and obsolete. A furnace body is constructed by sintering castable refractory as follows. First, a coil assembly is formed by covering coil inductors in such a manner that they are insulated from one another and from ground. Granular refractory, or stamp material is put inside the coil assembly thus formed, and is then hardened by pounding to form a furnace bottom. With a metal form set on the furnace bottom, similar stamp material is hardened by pounding to form the side wall of the furnace body. Thereafter, a metal form and ground metal are put in the furnace body. After being sintered at a low temperature with a burner, the ground metal is made molten through induction heating the ground metal with the energized, coil, thereby sintering the stamp material in the furnace. In this case, the metal form is melted together with the ground metal, or a metal form having a high melting point is used, so that it can be removed and used again.

A conventional furnace building method of this type has been disclosed by Japanese Patent Application Publication No. 53190/1981. In the method, boron oxide ($B_2O_2$) is used as a sintering agent for silica stamp material so that, unlike a conventional method of using boric acid ($H_3BO_3$) the adverse effect of water content, that is a dehydrating reaction during sintering, is eliminated.

In a furnace utilizing the earlier-described molten metal leakage detecting technique, even if the damage to the furnace body is not serious, water vapor present in the refractory material comprising the furnace body (such as natural silica), or the metallic vapor provided when the metal billets to be sintered are low melting point material (such as lead or zinc, zinc-plated iron plates, or zinc-copper alloy), will occasionally leak out of pores in the furnace body during the furnace operation.

As is apparent from the above description, even when the furnace body is not serious, with only slight steam or metallic vapor leaks, and even when the peripheral components of the furnace body, especially the induction coil, are not adversely affected, it appears that a molten metal leak has occurred. An unnecessary furnace repair operation may result. As was described above, the furnace body is formed by hardening granular refractory material through pounding. Accordingly, the furnace body has a number of pores. Hence, even when the furnace body is in normal state, the vapor of low melting point metal (such as lead or zinc) will sometimes pass through the pores, causing the leak detecting means to give erroneous indications.

In the above-described conventional furnace building technique, no moisture is produced by the dehydration of boron. However, with stamp materials such as silica stamp material, magnesia stamp material, alumina stamp material, mullite stamp material and spinel stamp material, moisture is produced because of the water contained therein. If, during sintering, the quantity of steam produced and the quantity of steam discharged become greatly different from each other, then cavities are formed in the refractory material. The resultant structure is low in refractoriness. Thus, the quick temperature increase of the metal form is limited.

SUMMARY OF THE INVENTION

Accordingly, it is an object of this invention to provide an induction furnace in which no vapor of low boiling point metal can pass through the furnace wall, and leakage of the molten metal is prevented if cracks formed in the furnace wall are not large.

Another object of the invention is to provide an induction furnace which is a structure high in refractoriness while the sintering time required in building the furnace is reduced.

The foregoing objects and other objects of the invention have been achieved by the provision of an induction furnace which, according to the invention, comprises: a furnace body including a wall formed by sintering castable refractory material in which gas passageways are formed in the furnace wall and a common pipe connecting the gas passageways which is connected to a gas conveying unit provided outside of the furnace wall.

In the furnace, a fine gas blocking layer may be provided so as to surround the gas passageways.

Furthermore, in the furnace, the gas passageways may be a plurality of pipes, each pipe having a plurality of small holes which are buried in the furnace wall. In another embodiment, the gas passageways are made up of a plurality of grooves formed in the inner surface of a fine gas blocking layer, and porous sheets fitted are in the grooves. In another embodiment, the gas passageways are formed in porous solid structure.

During operation of the induction furnace of the invention, the gas passageways formed in the furnace wall are pressurized through the communicating pipe by the gas conveying unit, such as a compressor. The pressurization results in an increase in the internal pressure of the porous furnace wall. Leakage of metallic vapor or molten metal through the furnace wall is thereby prevented. Hence, in the case where the furnace is provided with a molten metal leakage detecting means, the latter is prevented from erroneously leak detection. If necessary, the molten metal leakage detecting means may be eliminated. In this case, the furnace wall is visually inspected for damage when the molten metal is discharged, to determine whether or not it is necessary to repair the furnace.

In building the furnace, the steam is removed from the furnace body by the gas conveying unit such as a vacuum pump. This will prevent the formation of cavities in the furnace wall, and will contribute to the reduction of the sintering time.

The gas blocking layer surrounding the gas passageways formed in the furnace wall blocks the internal pressure of the furnace wall at the outer surface of the latter, thus increasing the effect of the gas passageways, and decreasing the quantity of gas in use. In addition, in the case where the gas passageways are the pipes or grooves, the latter can be arranged at large intervals with respect to the distance between the inner surface of the furnace wall and the pipes or grooves.

The nature, principle and utility of the invention will become more apparent from the following detailed description when read in conduction with the accompanying drawings, in which like parts are designated by like reference numerals or characters.

DETAILED DESCRIPTION OF THE INVENTION

Figure 4:
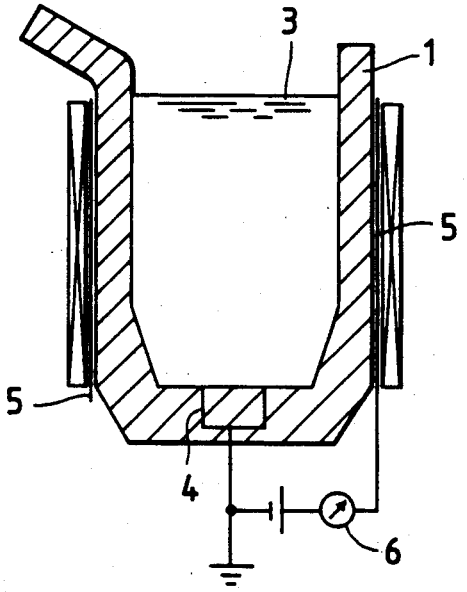
FIG. 4 PRIOR ART
FIG. 4 is a cross-sectional view showing a conventional induction furnace.

A first embodiment of the present invention will be described with reference to FIGS. 1 and 2, in which components which are functionally equal to those which have been already described with reference to FIG. 4 are therefore designated by the same reference numerals or characters.

Figure 1:
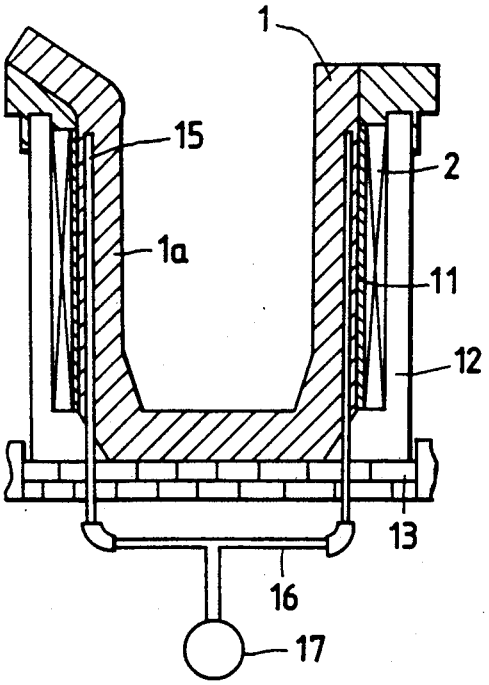
FIG. 1 is a sectional view showing a first embodiment of an induction furnace according to the present invention.
Figure 2:
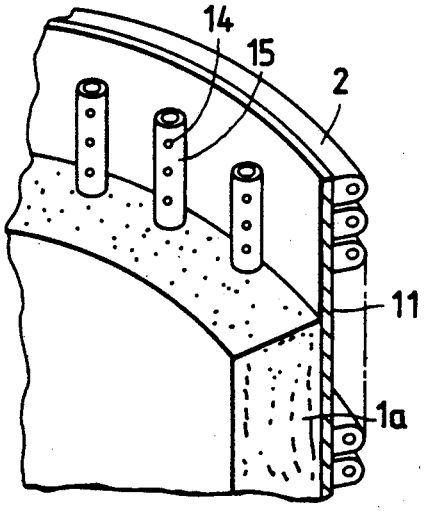
FIG. 2 is a perspective view showing a portion of the induction furnace illustrated in FIG. 1.

As shown in FIGS. 1 and 2, an induction coil 2 is wound about a porous furnace body 1 on a fine gas blocking layer 11. Fine gas blocking layer 11 is made of a heat resistant material such as a shaped cement sheet. The furnace body 1 is formed by sintering silica, magnesia, alumina or spinel granular refractory material. A yoke 12 is provided over the induction coil 2. The assembly thus formed is set on a floor 13 formed with bricks.

A plurality of metal or ceramic nozzle pipes 15 having a number of small holes 14 are provided inside the wall 1*a* of the furnace body 1 in contact with the gas blocking layer 11. The plurality of nozzle pipes 15 are connected through a common pipe 16 to a gas conveying unit 17, such as a compressor or vacuum pump, installed outside the furnace.

During operation of the furnace, the gas conveying unit 17 supplies gas through the common pipe 16 into the plurality of nozzle pipes 15 buried in the furnace wall 1*a*, increasing the pressure of the nozzle pipes 15, as a result of which the pressure in the furnace wall 1*a* is increased through the small holes 14 of the nozzle pipes. The increased pressure in furnace wall 1*a* prevents leakage of metal vapor or molten metal therethrough. Accordingly, the molten metal leakage detecting means (not shown) is prevented from erroneous operation. In some case, the molten metal leakage detecting means may be eliminated. In this case, when the molten metal has been discharged, the furnace wall 1*a* can be visually inspected for damage to determine whether or not it is necessary to rebuild the furnace body.

In building the furnace body, the gas conveying unit 17 can be used to removed entrapped water vapor from the furnace wall 1*a*, resulting in a reduction in the required sintering time.

In this operation, since the gas blocking layer 11 surrounds the plurality of nozzle pipes 15*a* buried in the furnace wall 1*a*, the internal pressure of the furnace wall 1*a* is blocked by the outer gas blocking layer 11, whereby the quantity of gas for use can be minimized. In addition, for the same reason, the plurality of nozzle pipes 15 can be arranged at large intervals when compared with the distance between the inner surface of the furnace wall and the nozzle pipes 15.

Figure 3:
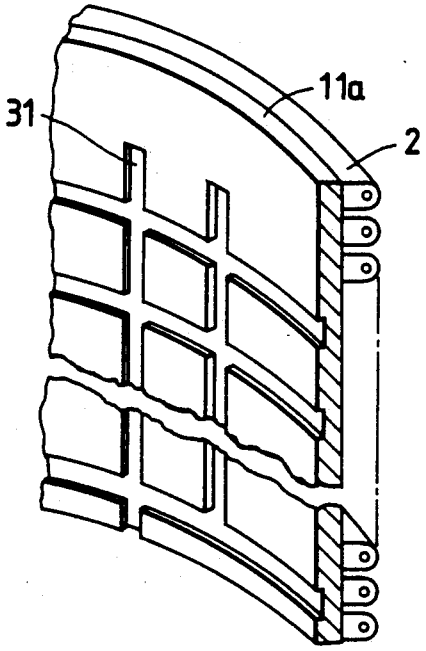
FIG. 3 is a perspective view showing a portion of a second embodiment of the induction furnace according to the present invention.

In a second embodiment of the invention, shown in FIG. 3, a gas blocking layer 11*a* made of coil cement is provided between the induction coil 2 and the furnace wall (not shown). A plurality of grooves 31 are formed in the inner peripheral surface of the gas blocking layer 11*a*, with some of them extending vertically, and others horizontally. Porous sheets formed by weaving carbon graphite fibers or the like are inserted in the grooves to provide gas passageways. As described above, the first embodiment included a plurality of nozzles pipes 15 buried in the furnace walls. However, the second embodiment shown in FIG. 3, includes a plurality of grooves 31 formed in the wall, with the porous sheets inserted therein. Therefore, the second embodiment can be formed more readily and more quickly.

In a third embodiment of the invention (not illustrated) a porous solid structure made of stainless steel wool or the like is laid over the outer cylindrical surface of the furnace wall 1*a* to provide gas passageways. The end portion of the common pipe 16 connected to the gas conveying unit is then inserted into the porous solid structure.

Referring back to FIG. 3, in stead of the porous sheets, the above-described porous solid structure may be inserted in the grooves 31.

In the above-described embodiments, the internal pressure of the furnace wall may be increased to a pressure which is high enough to block the leakage of metallic vapor or molten metal. Alternatively, the furnace body can be made of a refractory material larger in grain size, in order to discharge gas through the inner surface of the furnace wall. This will prevent the sticking of slag to the inner surface of the furnace wall. In this case, the slag is caused to float with the gas. Furthermore, if, in this case, oxygen gas is used, then the molten metal can be decarbonized or degasified.

As described earlier, in the induction furnace of the present invention, the gas passageways are formed in the porous furnace wall which is formed by sintering castable refractory material, and the pipe communication with the gas passageway is connected to the gas conveying unit provided outside of the furnace wall.

During operation, internal pressure is applied to the porous furnace wall to prevent the leakage of metallic vapor or molten metal. In the case where the furnace body is provided with a molten metal leakage detecting means, the latter is prevented from erroneous operation. If the gas passageways are increased in concentration, and the internal pressure is increased, then the molten metal leakage detecting means may be eliminated. Furthermore, in building the furnace body, the pressure can be decreased to positively absorb the moisture produced during sintering, thereby preventing formation of cavities in the furnace wall, or formation of a coarse-grained furnace wall. This results in the sintering time being reduced, and an increase operating efficiency.

In addition, the gas is positively discharged from the furnace wall, to prevent the sticking of slag to the furnace wall, and to permit the decarbonization or degasification of the molten metal.

While certain embodiments have been described, the invention is not limited only to the embodiments disclosed. The technical concept of the invention can be applied to any induction furnace in which a back castable refractory material layer is formed outside a finely sintered regular crucible. Accordingly, departures may be made from the details disclosed herein, without departing from the scope of the applicant's claimed invention.

What is claimed is:

1. An induction furnace, comprising:
   - a furnace body including a base, and a furnace wall projecting upwardly from the base having an outer peripheral surface;
   - a coil wrapped about said outer peripheral surface of said furnace wall;
   - a plurality of passageways chased in said furnace wall and penetrating said outer peripheral surface;
   - a common pipe connecting said plurality of passageways external to said furnace body; and
   - a gas conveying unit attached to said common pipe external to said furnace body.

2. The induction furnace of claim 1, wherein said passageways include pipes, each said pipe having a first portion chased in said furnace wall, and a second portion extending external to said furnace body.

3. The induction furnace of claim 2, wherein the first portion of each said pipe includes a plurality of openings, and the second portion of each said pipe includes a single opening connected to said common pipe.

4. The induction furnace of claim 1, wherein said furnace wall includes a porous inner layer of sintered castable refractory material, and gas-blocking outer layer.

5. The induction furnace of claim 4, wherein said passageways include grooves chased in said furnace wall between said porous inner layer and said outer gas-blocking layer.

6. The induction furnace of claim 5, wherein said grooves have a plurality of porous sheets inserted therein.

7. The induction furnace of claim 1, wherein said gas conveying unit includes a vacuum pump.

8. The induction furnace of claim 1, wherein said gas-conveying unit includes a compressor.

* * * * *

UNITED STATES PATENT AND TRADEMARK OFFICE

CERTIFICATE OF CORRECTION

PATENT NO. : 4,989,218

DATED : January 29, 1991

INVENTOR(S) : Masao Tateno

It is certified that error appears in the above-identified patent and that said Letters Patent is hereby corrected as shown below:

ON THE TITLE PAGE AND IN COLUMN 1:

In the Title, 2nd Line, "MELTING21FURNANCE" should be --MELTING FURNANCE--.

Signed and Sealed this

Twenty-ninth Day of September, 1992

*Attest:*

DOUGLAS B. COMER

*Attesting Officer*

*Acting Commissioner of Patents and Trademarks*